US008039725B2

(12) United States Patent
Kato et al.

(10) Patent No.: US 8,039,725 B2
(45) Date of Patent: Oct. 18, 2011

(54) ELECTRONIC KEYBOARD INSTRUMENT

(75) Inventors: Takashi Kato, Hamamatsu (JP); Takashi Fujita, Hamamatsu (JP); Hideki Ishihara, Jakarta (JP); Akiko Shinjo, Hamamatsu (JP); Akito Oba, Hamamatsu (JP)

(73) Assignee: Yamaha Corporation (JP)

( * ) Notice: Subject to any disclaimer, the term of this patent is extended or adjusted under 35 U.S.C. 154(b) by 20 days.

(21) Appl. No.: 12/646,346

(22) Filed: Dec. 23, 2009

(65) Prior Publication Data

US 2010/0192756 A1 Aug. 5, 2010

(30) Foreign Application Priority Data

Dec. 26, 2008 (JP) ..... 2008-332444

(51) Int. Cl.
*G10H 1/32* (2006.01)
*G10H 3/00* (2006.01)

(52) U.S. Cl. ..... 84/744; 84/177

(58) Field of Classification Search ..... 84/13, 743, 84/744, 177
See application file for complete search history.

(56) References Cited

U.S. PATENT DOCUMENTS

| | | | | |
|---|---|---|---|---|
| 5,335,283 | A * | 8/1994 | Torii | 381/118 |
| 5,789,693 | A * | 8/1998 | Lawson | 84/744 |
| 6,392,136 | B2 * | 5/2002 | Kondo et al. | 84/718 |
| 6,888,058 | B2 * | 5/2005 | Urai et al. | 84/737 |
| 7,332,669 | B2 * | 2/2008 | Shadd | 84/742 |
| 7,432,428 | B2 * | 10/2008 | Kunisada et al. | 84/13 |
| 7,678,988 | B2 * | 3/2010 | Sato et al. | 84/743 |
| 7,804,017 | B2 * | 9/2010 | Hata et al. | 84/644 |
| 2001/0052284 | A1 * | 12/2001 | Kondo et al. | 84/718 |
| 2003/0015086 | A1 * | 1/2003 | Katz | 84/644 |
| 2005/0150368 | A1 * | 7/2005 | Izumi et al. | 84/746 |
| 2007/0017353 | A1 * | 1/2007 | Kunisada et al. | 84/723 |
| 2008/0127798 | A1 * | 6/2008 | Sato et al. | 84/192 |
| 2009/0241756 | A1 * | 10/2009 | Tajima et al. | 84/604 |
| 2010/0166220 | A1 * | 7/2010 | Okumura | 381/99 |
| 2010/0192756 | A1 * | 8/2010 | Kato et al. | 84/744 |

FOREIGN PATENT DOCUMENTS

JP 3644356 B2 4/2005

* cited by examiner

*Primary Examiner* — Jeffrey Donels
(74) *Attorney, Agent, or Firm* — Rossi, Kimms & McDowell LLP

(57) ABSTRACT

An electronic keyboard instrument that emits sounds in both upward and downward directions from speakers solely for upward sound emission and from speakers solely for downward sound emission to realize acoustics similar to that of acoustic piano, and constitutes rear parts of resonance chambers in a speaker box by a common partition plate to prevent the speaker box from becoming complicated in construction. Woofers directed downward are disposed at a lower part of the speaker box, and squawker directed upward are disposed at an upper part of the speaker box. The internal space of the speaker box is partitioned by one horizontal partition plate into an upper space where resonance chambers for the squawkers are defined by vertical partition plates and a lower space where resonance chambers for the woofers are defined by vertical partition plates. Rear parts of the resonance chambers are constituted by the horizontal partition plate.

8 Claims, 8 Drawing Sheets

12
14
15
WAVEFORM DATA GROUP
dL
dC
dR
dB
M I X
L1
L2
L3
L4
L5
L6
L7
L8
L9
L10
L11
L12
61
HPF
LPF
41
42
43
44
45
46
47
48
49
72
73
76
w1
w2
DAC
NF
74
75
62
63
64
65
66
67
68
69
70
71
TrL
TrR
ACS1
ACS2
S1
S2
S0
TwL
WoL
SqL
TwC
WoC
SqC
TwR
WoR
SqR
TwB
WoB
SqB

ELECTRONIC KEYBOARD INSTRUMENT

BACKGROUND OF THE INVENTION

1. Field of the Invention

The present invention relates to an electronic keyboard instrument having a speaker box.

2. Description of the Related Art

Conventionally, it has been known to provide an electronic keyboard instrument with a speaker box so as to ensure ample sound volume and produce musical tones with nuances close to those of acoustic piano (see, Japanese Patent Publication No. 3644356).

In the keyboard instrument disclosed in this patent publication, speakers are mounted on an instrument main body so as to be directed upward and open holes are formed in and extend through an enclosure that covers rear surfaces of the speakers, whereby sounds are radiated upwardly and downwardly from the speakers and the open holes. Sounds radiated from the speakers are reflected by a reflector board of the keyboard instrument and transmitted to the audience, whereas sounds passing through the open holes are reflected by the floor and transmitted to the audience.

However, the downward sound radiation in this keyboard instrument made by causing air vibration produced by the upwardly directed speakers to propagate downward via the open holes of the enclosure is insufficient in realizing ample acoustic sounds as provided by a grand piano. In mounting the speaker box on the electronic keyboard instrument, there is a demand to prevent the construction from being complicated.

SUMMARY OF THE INVENTION

The present invention provides an electronic keyboard instrument that emits sounds in both upward and downward directions from speakers solely for upward sound emission and speakers solely for downward sound emission to thereby realize acoustics similar to that of acoustic piano, and constitutes rear parts of resonance chambers in a speaker box by a common partition plate to prevent the speaker box from being complicated in construction.

According to the present invention, there is provided an electronic keyboard instrument, which comprises an instrument main body, a speaker box disposed on the instrument main body, a plurality of speakers disposed at an upper part of the speaker box so as to be directed upward when the electronic keyboard instrument is in use for performance, a plurality of speakers disposed at a lower part of the speaker box so as to be directed downward when the electronic keyboard instrument is in use for performance, one partition plate provided in the speaker box so as to partition an internal space of the speaker box into upper and lower internal spaces, resonance chambers formed independently of one another in the upper internal space of the speaker box so as to correspond to respective ones of the speakers disposed to be directed upward, and resonance chambers formed independently of one another in the lower internal space of the speaker box so as to correspond to respective ones of the speakers disposed to be directed downward, wherein rear parts of the resonance chambers are constituted by the one partition plate.

With this invention, acoustics similar to that of acoustic piano can be realized by emitting sounds in both upward and downward directions from the speakers solely for upward sound emission and the speakers solely for downward sound emission, and the speaker box can be prevented from being complicated in construction by constituting the rear parts of the resonance chambers by the common partition plate.

The instrument main body can be formed into a grand piano shape as viewed in plan, and the speaker box can be disposed as viewed in plan in a region corresponding to a region where a grand piano soundboard is disposed.

In that case, a sound emitting position can be made close to a position of the grand piano soundboard, whereby acoustics similar to that of grand piano can be realized.

The speakers can be comprised of four speakers disposed above the partition plate and four speakers disposed below the partition plate, three of the four speakers disposed above the partition plate can be arranged in a line along a left-right direction on a front side of the speaker box and a remaining one of these four speakers can be located on a rear side of the speaker box, and three of the four speakers disposed below the partition plate can be arranged in a line along the left-right direction on the front side of the speaker box and a remaining one of these four speakers can be located on the rear side of the speaker box.

In that case, appropriate volumes can easily be allocated to the resonance chambers, thereby making it possible to efficiently dispose the speaker box at a position corresponding to a position where a grand piano soundboard is disposed.

The resonance chamber corresponding to the remaining one of the four speakers disposed above the partition plate can be in contact, via a vertical partition plate, with the resonance chambers corresponding to the three of these four speakers, and the resonance chamber corresponding to the remaining one of the four speakers disposed below the partition plate can be in contact, via a vertical partition plate, with the resonance chambers corresponding to the three of these four speakers.

In that case, the volumes of the resonance chambers can efficiently be ensured.

A stepped portion can be provided on one of upper and lower sides of the speaker box with respect to the one partition plate, and speakers for low pitch tones among the speakers can be disposed on another of the upper and lower sides of the speaker box and speakers for intermediate or high pitch tones among the speakers can be disposed on the one of the upper and lower sides of the speaker box.

In that case, the space-saving inside the instrument main body can be achieved, while ensuring that the resonance chambers corresponding to the speakers for low pitch tones each have a large volume.

Electrical components can be disposed in a space of the stepped portion.

In that case, effective space utilization can be achieved.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1A:
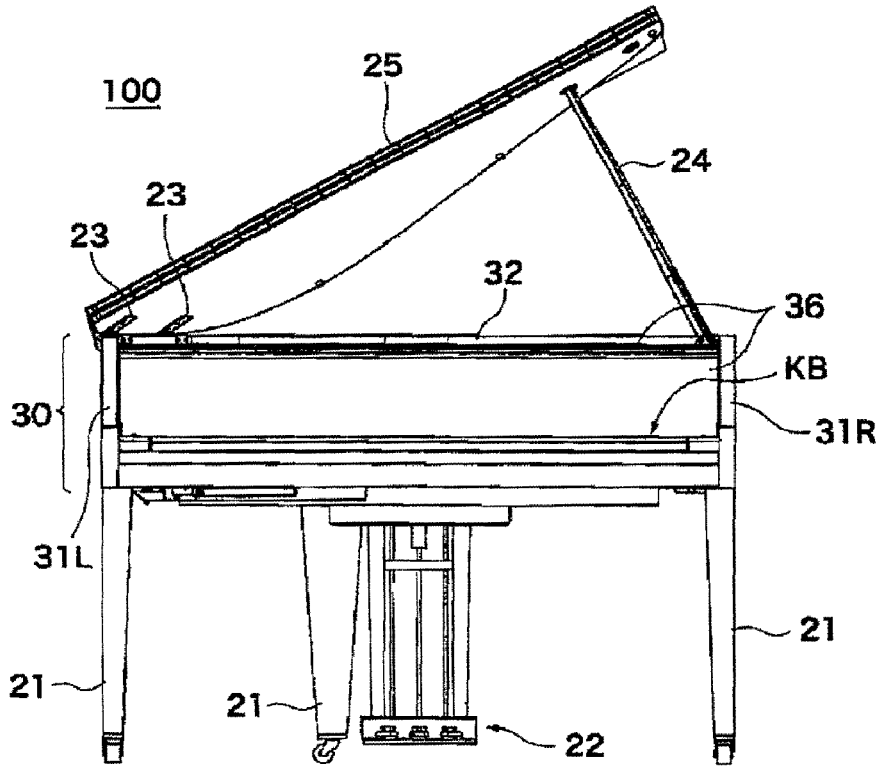
FIG. 1A is a front view of an electronic keyboard instrument according to one embodiment of this invention.
Figure 1B:
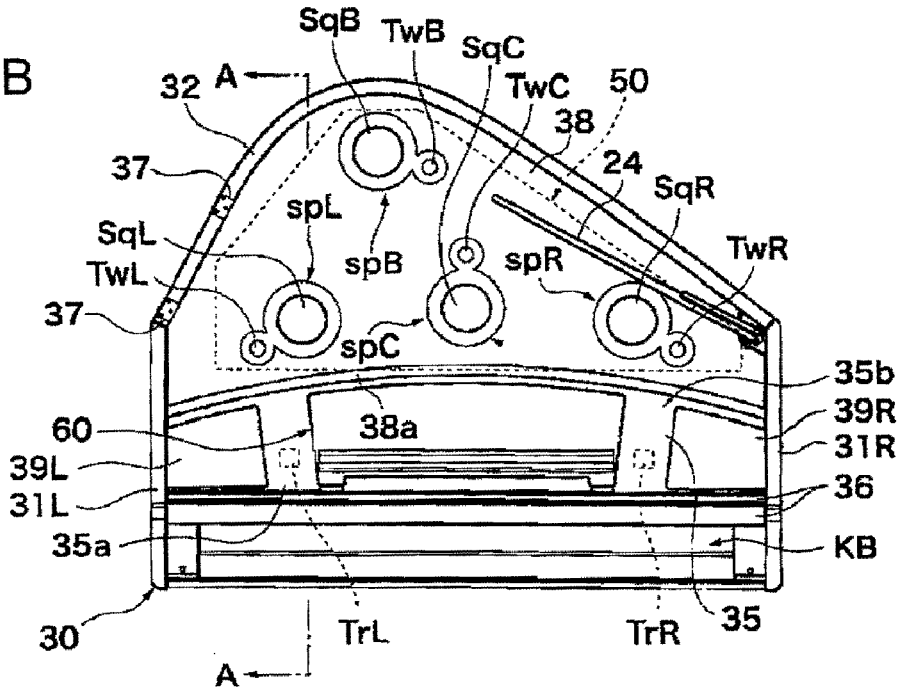
FIG. 1B is a plan view showing the electronic keyboard instrument in a state where a roof plate is detached therefrom.

FIG. 1A shows in front view an electronic keyboard instrument according to one embodiment of this invention. The electronic keyboard instrument 100 is provided at an upper part thereof with an openable and closable roof plate 25, which is in an open state in FIG. 1A. FIG. 1B shows in plan view the keyboard instrument 100 in a state where the roof plate 25 is detached therefrom. In FIGS. 1A and 1B, a fallboard 36 that covers a keyboard KB is shown in an open state.

Figure 2:
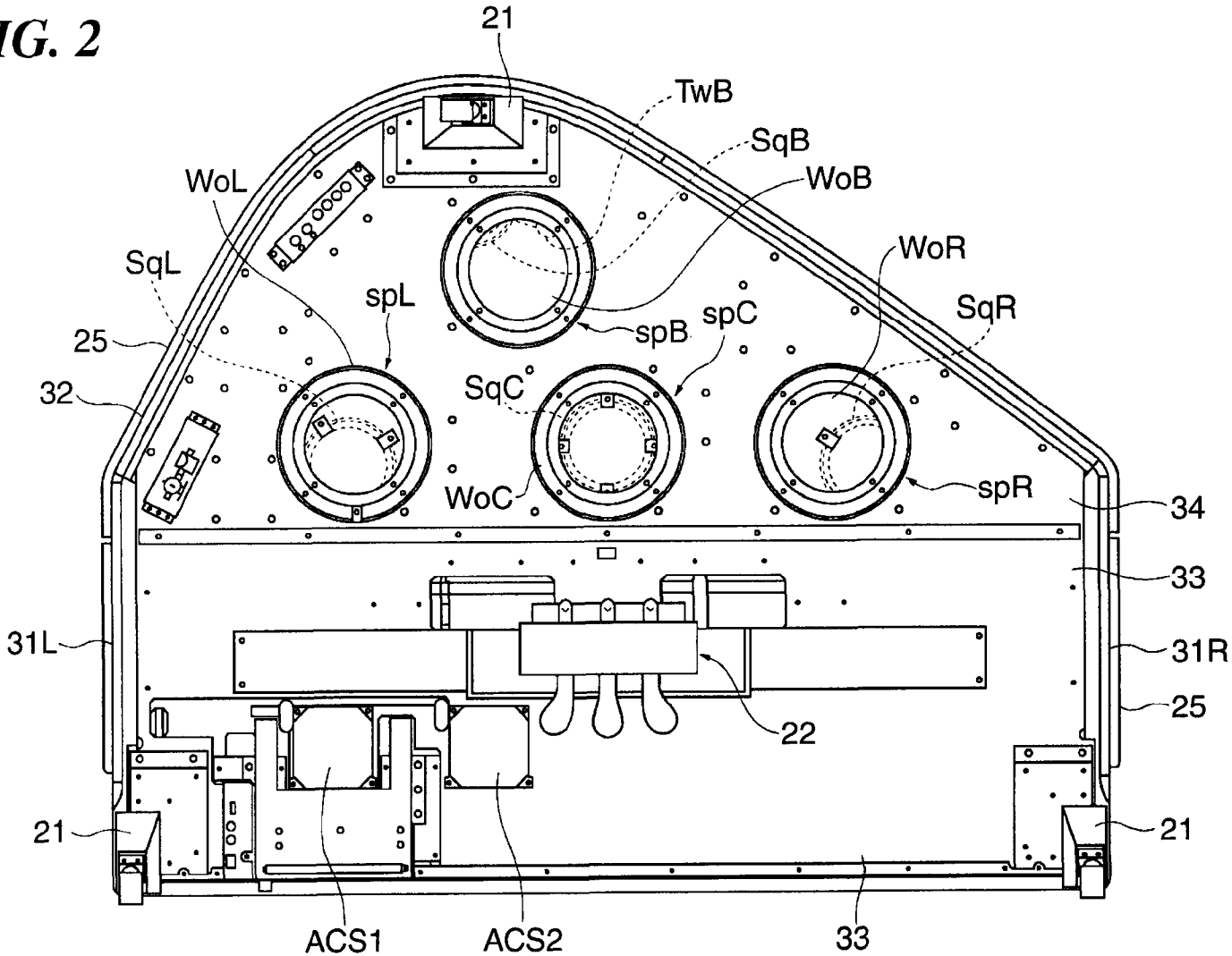
FIG. 2 is a bottom view of the electronic keyboard instrument.
Figure 3:
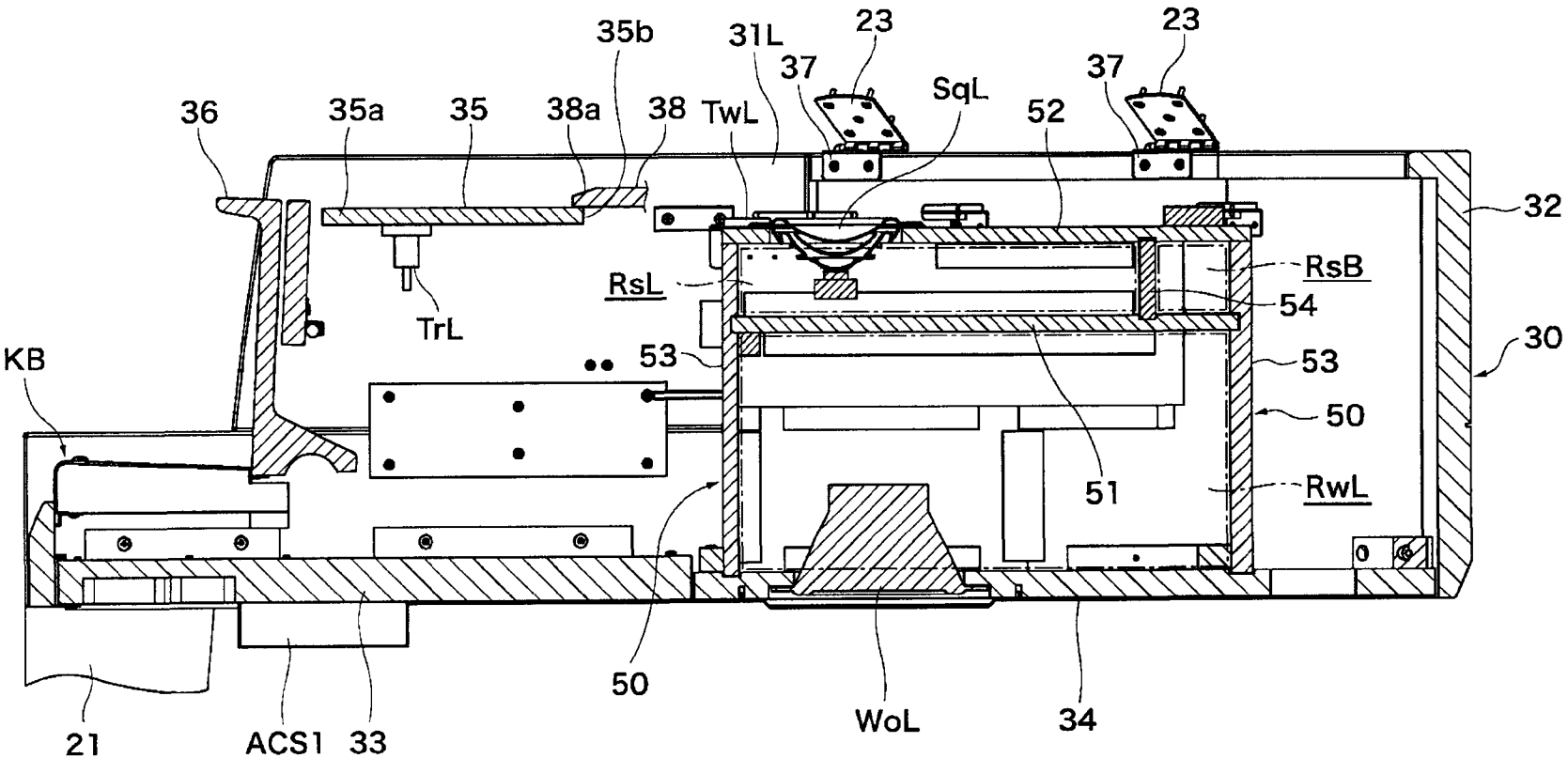
FIG. 3 is a section view taken along line A-A in FIG. 1B.

FIG. 2 shows the keyboard instrument 100 in bottom view, and FIG. 3 is a section view taken along line A-A in FIG. 1B. Illustrations of some constituent elements are omitted in FIG. 3.

As shown in FIGS. 1A and 2, the instrument main body 30 is supported by three legs 21. In the following, the terms "vertical direction", "left-right direction" and "front-rear direction" refer to directions as viewed from a player in front of the keyboard instrument 100 placed on the floor.

The instrument main body 30 has left-hand and right-hand side plates 31L, 31R and a curved back plate 32 extending between rear ends of the side plates 31L, 31R, and is similar in planar shape to a grand piano. The keyboard KB has seesaw type keys (not shown) and is disposed at a frontmost part of the instrument main body 30 and between the side plates 31L, 31R.

As shown in FIGS. 2 and 3, a bottom part of the instrument main body 30 is constituted by front and rear keybeds 33, 34. As shown in FIG. 1B, an upper part of the instrument main body 30 is constituted by a soundboard 35 and an intermediate plate 38 disposed rearward of the soundboard 35 (see FIG. 3 as well). The intermediate plate 38 is similar in planar shape to a grand piano soundboard, and fixed to the side plates 31L, 31R and the back plate 32. The soundboard 35 has a front end portion 35*a* thereof extending in the left-right direction and a rear end portion 35*b* thereof formed into an arch shape which is convex rearward. The rear end portion 35*b* of the soundboard 35 is connected to a lower part of the front end portion 38*a* of the intermediate plate 38 by a fixture (not shown).

The roof plate 25 is mounted via hinged roof plate attachment fittings 23 (see FIGS. 1A and 3) to two mounting fittings 37 (e.g., metal fittings) provided at an upper end of the left half of the back plate 32 (see FIGS. 1B and 3) such that the roof plate 25 is openable and closable relative to the back plate 32. An open state of the roof plate 25 is maintained by a support rod 24 (see FIG. 1A).

As shown in FIG. 1B, a music stand device 60 is disposed at the center in the left-right directions right above the soundboard 35, and fixed to members (not shown) which are in turn fixed to the side plates 31L, 31R. The lamp stands 39L, 39R are disposed on the left and right sides of the music stand device 60 right above left and right end portions of the soundboard 35, and fixed to the side plates 31L, 31R or fixed to members which are in turn fixed to the side plates 31L, 31R. The soundboard 35 is provided with run-off portions (not shown), whereby the music stand device 60 and the lamp stands 39L, 39R are mounted so as not to engage with the soundboard 35 and so as not to be in contact with one another. It should be noted that rubber members or other elastic members can be disposed to fill gaps between the soundboard, the music stand, and the lamp stands so that the soundboard, the music stand, and the lamp stands are made in contact with one another via the elastic members.

Transducers TrL, TrR are disposed on a lower surface of the soundboard 35 (see FIGS. 1B and 3) and between the lamp stands 39L, 39R and the music stand device 60 as viewed in plan view. The transducers TrL, TrR are configured to vibrate (excite) the soundboard 35, thereby generating sounds. The front keybed 33 is disposed and configured to function as a soundboard. On a lower surface of the left half of the front keybed 33, there are disposed vibration exciting units ACS1, ACS2 (see FIGS. 2 and 3) each having a transducer that generates a vibration force by electromagnetic induction and configured to vibrate (excite) the front keybed 33 for sound generation.

As shown in FIGS. 1B and 3, a speaker box 50 is disposed at a rear half of the instrument main body 30. As viewed in plan view, the speaker box 50 is disposed in a region where the intermediate plate 38 is disposed. This region corresponds to a region in a grand piano where a ground piano soundboard is disposed.

Figure 4A:
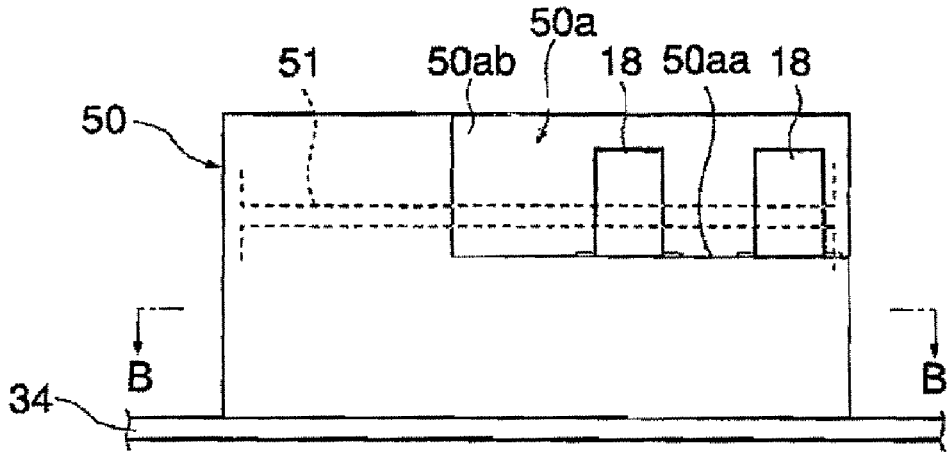
FIG. 4A is a left side view of a speaker box of the keyboard instrument.
Figure 4B:
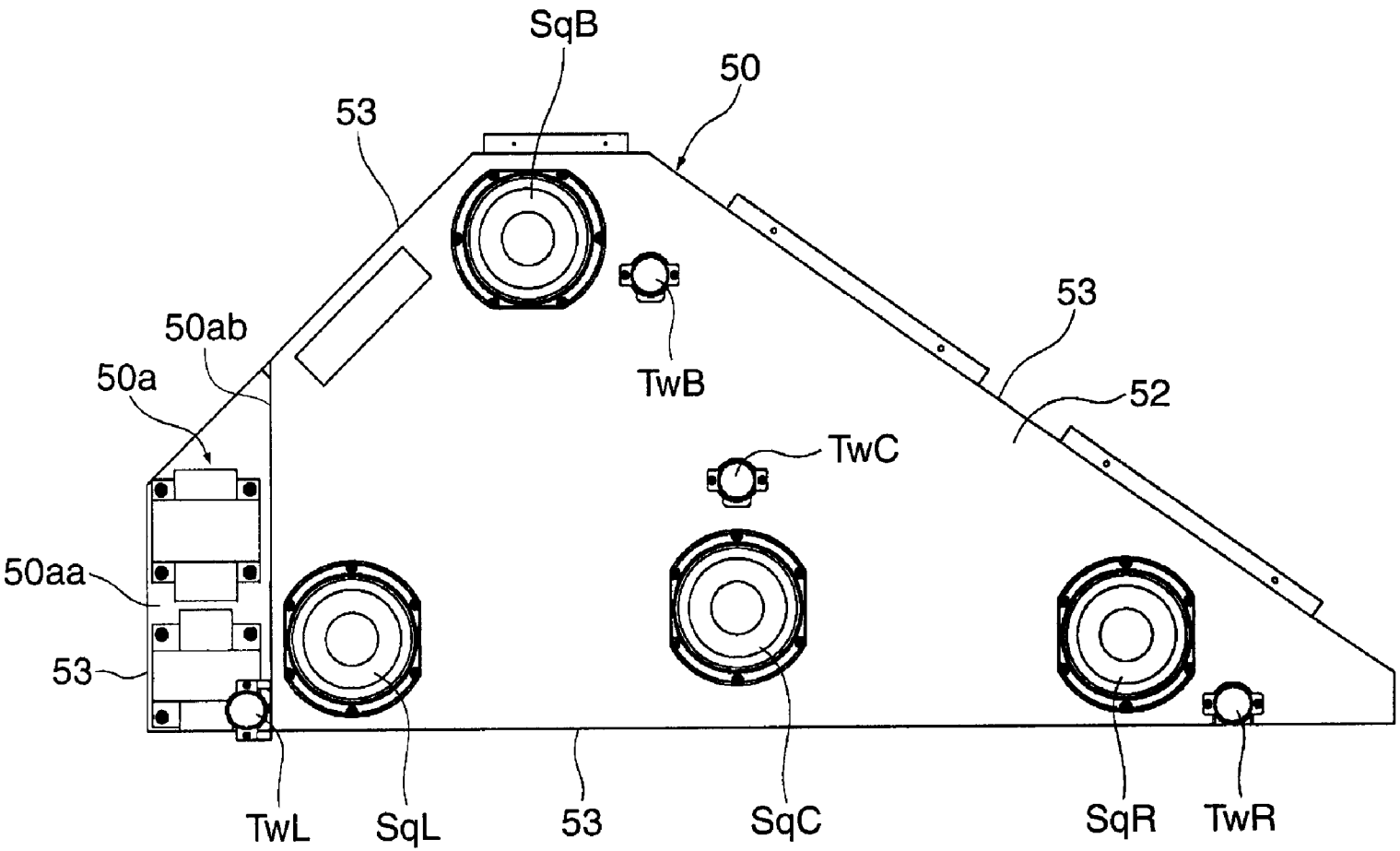
FIG. 4B is a plan view of the speaker box.

FIGS. 4A and 4B show the speaker box 50 in left side view and plan view. As shown in FIGS. 2, 3 and 4A, the rear keybed 34 constitutes a bottom portion of the speaker box 50 that has a housing constituted by an upper plate 52, a peripheral wall 53, and a part of the rear keybed 34 (see FIG. 3).

As shown in FIGS. 4A and 4B, a stepped portion 50*a* is formed at a left end portion of the speaker box 50. The stepped portion 50*a* is defined by an upper surface 50*aa* of the left end portion of the speaker box 50 extending horizontally at a location downward of a horizontal partition plate 51 of the speaker box 50 and a left side surface 50*ab* of an upper half of the speaker box 50, and is open upward, forward, and rearward. For effective space utilization, electrical components 18 are disposed within a space of the stepped portion 50*a*. The electrical components 18 are, e.g., musical tone generating components, but any types and numbers of components can be disposed in the space of the stepped portion 50*a*. Since the electrical components 18 are disposed within the space of the stepped portion 50*a*, a distance from an upper portion of the instrument main body 30 to the electrical components 18 at the time of interior maintenance with the roof plate 25 open can be shortened, which is advantageous in that the workability is improved.

As shown in FIG. 2, four woofers WoL, WoC, WoR, WoB (hereinafter collectively denoted by Wo), i.e., speakers for low pitch tones, are directed downward and disposed on the rear keybed 34 at a part thereof corresponding to a bottom part of the speaker box 50. As shown in FIG. 4B, four squawkers SqL, SqC, SqR, SqB (hereinafter collectively denoted by Sq), i.e., speakers for intermediate pitch tones, and four tweeters TwL, TwC, TwR, TwB (hereinafter collectively denoted by Tw), i.e., speakers for high pitch tones, are directed upward and disposed at an upper part of the speaker box 50 (mainly on the upper plate 52) so as to correspond to the woofers WoL, WoC, WoR, WoB. The squawkers Sq and the tweeters Tw are therefore directed opposite from the woofers Wo.

The squawkers Sq are disposed in the same plane as one another, and the tweeters Tw are disposed in the same plane as one another. The tweeters Tw are located upward of the squawkers Sq. It should be noted that the squawkers Sq and the tweeters Tw can be disposed in the same plane as one another. The woofers Wo at the bottom part of the speaker box 50 are disposed in the same plane as one another.

Speaker groups spL, spC, spR, and spB are each constituted by ones of the squawkers Sq, the tweeters Tw, and the woofers Wo which have the same suffix L, C, R, or B as one another and disposed close to one another as viewed in plan (see FIGS. 1B and 2). Specifically, the speaker group spL is constituted by the squawker SqL, the tweeter TwL, and the woofer WoL. The other speaker groups are denoted by spC, spR, and spB. The transducers TrL, TrR are nearly aligned in position with the speaker groups spL, spR as viewed in the left-right direction (see FIG. 1B).

As shown in FIGS. 2 and 4B, three sets of squawkers SqL, SqC, SqR and woofers WoL, WoC, WoR are disposed immediately rearward of the keyboard KB and at a left end portion, an intermediate portion, and a right end portion of the instrument main body 30, respectively, as viewed in plane view, and are arranged in a line along the left-right direction. In particular, the centers of the woofers WoL, WoC, WoR (the centers of circular cones) are located on a perfect straight line (see FIG. 2). On the other hand, the remaining set of squawker SqB and woofer WoB is disposed rearward of the three sets of squawkers SqL, SqC, SqR and woofers WoL, WoC, WoR. More specifically, the squawker SqB is disposed rearward of the squawkers SqL, SqC and located therebetween in the left-right direction (see FIG. 4B). The woofer WoB is disposed rearward of the woofers WoL, WoC and located therebetween in the left-right direction on the side slightly close to the woofer WoC (see FIG. 2).

With the above-described arrangement of the squawkers Sq and the woofers Wo, the speakers as sound sources are arranged to constitute a nearly plane sound source. In an arrangement that emits sounds only from left and right two speakers as in an ordinary electronic keyboard instrument, spherical waves are spread out from these two speakers as point sound sources into an acoustic space. As a result, the musical tone expression becomes quite different from that of acoustic piano. On the other hand, it is considered that in this embodiment, spherical waves from the four squawkers Sq (or the woofers Wo) disposed with the same orientation on the same plane interfere with one another such that a plane wave is synthesized. With this function, the plane wave is spread out into an acoustic space as with sound propagation in acoustic piano, and the resultant musical tone impression becomes close to that of acoustic piano. The four tweeters Tw also function to constitute a nearly plane sound source.

As shown in FIG. 2, as viewed in plan and bottom views, the squawkers SqL, SqC, SqR, SqB are disposed close to the woofers WoL, WoC, WoR, WoB in the horizontal direction so as to partly overlap the woofers, whereby a difference between a distance between the squawker Sq and a listening point located at nearly the same height as that of speaker box 50 and a distance between the woofers Wo and the listening point is made small.

As shown in FIG. 4, in the speaker group spL, the center of the tweeter TwL is positioned leftward and slightly forward of the center of the squawker SqL. In the speaker group spR, the center of the tweeter TwR is positioned rightward and slightly forward of the center of the squawker SqR. In the speaker group spC, the center of the tweeter TwC is positioned immediately rearward of the center of the squawker SqC. In the speaker group spB, the center of the tweeter TwB is positioned rightward and slightly forward of the center of the squawker SqB. The squawkers SqL, SqC, SqR are arrange in a line in the left-right direction. On the other hand, the tweeters TwL, TwC, TwR are arranged in an arch shape convex forward as seen from the player.

As a result, a difference between distances from the tweeters TwL, TwC, TwR to the player is made small. Since the distance difference is small, a separation feeling is suppressed although there is a tendency that high pitch tones are attenuated and sounds from tweeters close to the listening point is liable to be heard with emphasis, if the difference between distances to the listening point is large.

Figure 5A:
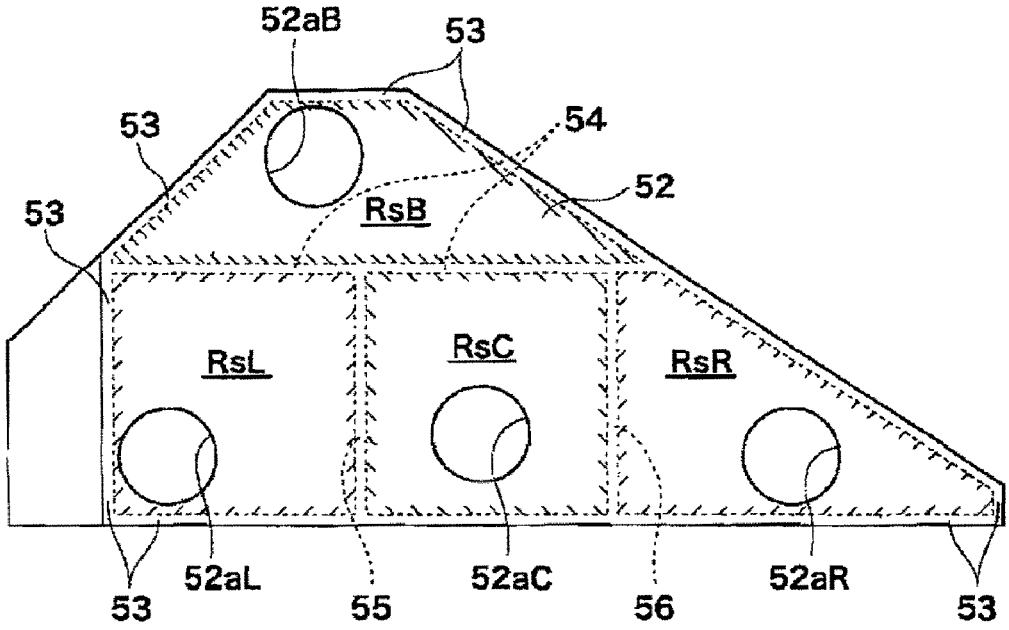
FIG. 5A is a plan view of the speaker box.
Figure 5B:
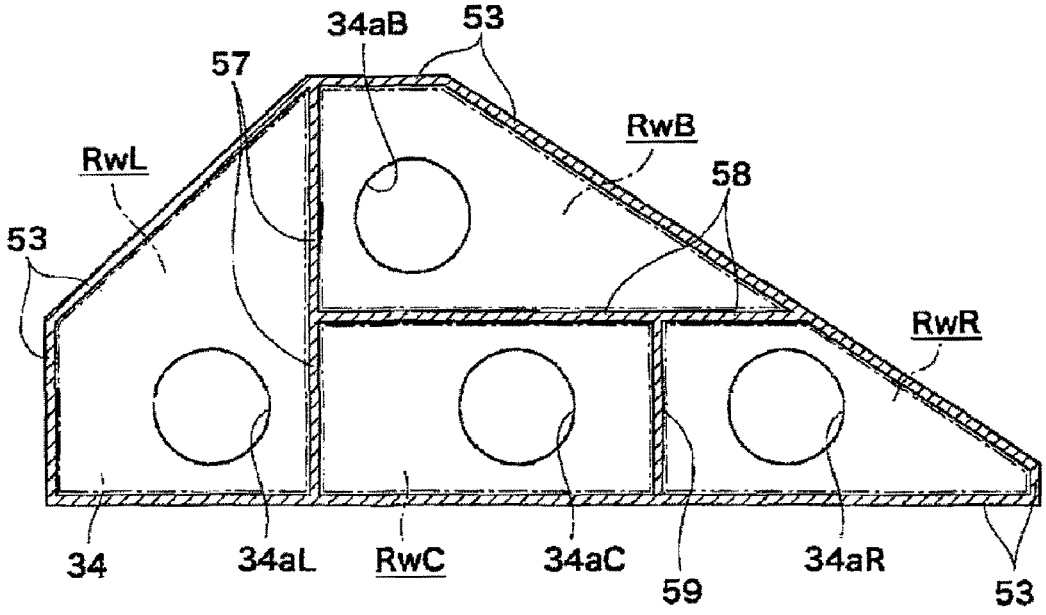
FIG. 5B is a section view taken along line B-B in FIG. 4A.

FIG. 5A shows the speaker box 50 in plan view, and FIG. 5B is a section view taken along line B-B in FIG. 4A.

As shown in FIG. 5A, the squawkers Sq are fitted into holes 52*a*L, 52*a*C, 52*a*R, 52*a*B formed in the upper plate 52 to correspond to the squawkers. As shown in FIG. 1B, the squawkers Sq and the tweeters Tw are exposed for sound emission via through holes formed in the intermediate plate 38 to correspond thereto. In FIG. 4A, illustrations of the tweeters TwL are omitted. The woofers Wo are fitted to holes 34*a*L, 34*a*C, 34*a*R, 34*a*B formed in the rear keybed 34 to correspond to the woofers (see FIG. 5B).

As shown in FIGS. 3 and 4A, the horizontal partition plate 51 is disposed slightly upward of a vertically intermediate of the speaker box 50, whereby the internal space of the speaker box 50 is partitioned into upper and lower spaces. As long as the horizontal partition plate 51 can partition the internal space of the speaker box 50 into upper and lower spaces, the horizontal partition plate 51 may not be disposed exactly horizontal and may not be formed into a flat plate.

As shown in FIG. 5A, the upper space inside the speaker box 50 above the horizontal partition plate 51 is divided by three vertical partition plates 54 to 56 into four spaces for the four squawkers Sq. Four independent resonance chambers RsL, RsC, RsR, RsB (hereinafter collectively denoted by Rs) that correspond to the squawkers Sq are defined by the vertical partition plates 54 to 56, the peripheral wall 53, and the upper plate 52. The four resonance chambers Rs are the same in volume as one another As shown in FIG. 5B, the lower space below the horizontal partition plate 51 is divided by three vertical partition plates 57 to 59 into four spaces for the four woofers Wo. Four independent resonance chambers RwL, RwC, RwR, RwB (hereinafter collectively denoted by Rw) that correspond to the woofers W0 are defined by the vertical partition plates 57 to 59, the peripheral wall 53, and the rear keybed 34. The four resonance chambers Rw are the same in volume as one another, but may not be the same in volume. The horizontal partition plate 51 and the vertical partition plate 54 to 59 are each fixed by, e.g., adhesive to the peripheral wall 53, and contact parts of these plates are also fixed by, e.g., adhesive to one another. The vertical partition plates 54 to 59 contribute to enhancement of the rigidity of the speaker box 50.

Rear parts of the resonance chamber Rs on the side of rear surfaces of the squawkers Sq are constituted by the horizontal partition plate 51. Rear parts of the resonance chambers Rw on the side of rear surfaces of the woofers Wo are also constituted by the horizontal partition plate 51. Since the rear parts of the upper and lower eight resonance chambers are constituted by the horizontal partition plate 51, the construction is prevented from being complicated.

The resonance chambers RsL, RsC, RsR are disposed on the front side and arranged in the left-right direction, and the resonance chamber RsB disposed on the rear side is in contact with the resonance chambers RsL, RsC, RsR via the vertical partition plate 54 (see FIG. 5A). The resonance chamber RwB is in contact with the resonance chamber RwL via the vertical partition plate 57 and in contact with the resonance chambers RwC, RwR via the vertical partition plate 58 (see FIG. 5B). As a result, the volumes of the resonance chambers Rs, Rw are efficiently ensured.

Figure 6:
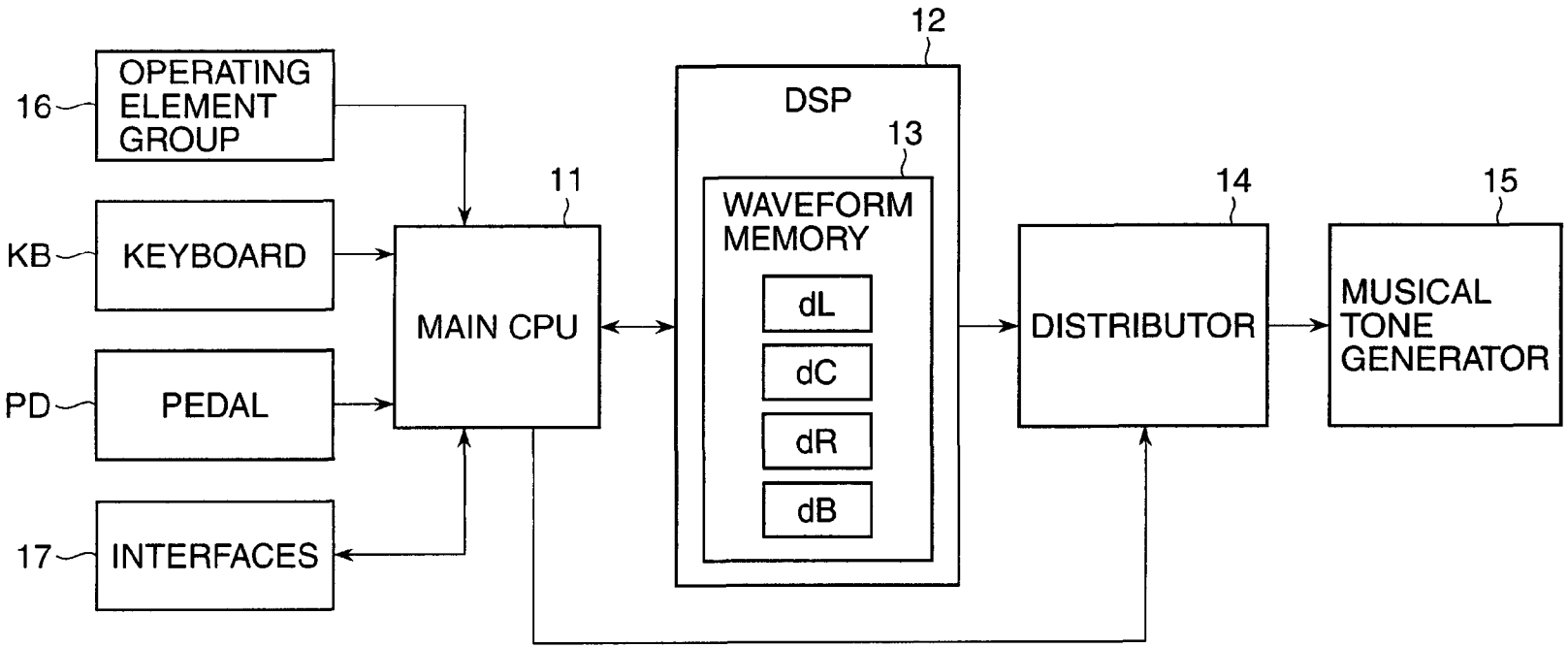
FIG. 6 is a block diagram showing the functional construction of the electronic keyboard instrument.

FIG. 6 shows in block diagram the functional construction of the electronic keyboard instrument 100. The electronic keyboard instrument 100 includes a main CPU 11 to which an operating element group 16, a pedal PD, interfaces 17, DSP 12, and a distributor 14 as well as the keyboard are connected. A musical tone generator 15 is connected to the distributor 14. States of manipulations on the keyboard KB, the operating element group 16, and the pedal PD are detected by manipulation detecting units (not shown), and detection signals are supplied to the main CPU 11. The distributor 14, the DSP 12, and the musical tone generator 15 constitute a sound generating device.

The operating element group 16 includes various operating elements such as a master volume operating element, an effect operating element, and an equipment setting operating element. The interfaces include, e.g., a MIDI interface and a wired or wireless communication interface. The main CPU 11 includes a ROM, a RAM, a timer, etc. (none of which are shown). The DSP 12 includes a CPU (not shown), a storage unit (not shown), and a waveform memory 13 in which waveform data groups dL, dC, dR, dB are stored in advance. The tone generator 15 includes amplifiers (not shown) as well as the woofers Wo, squawkers Sq, tweeters Tw, transducers TrL, TrR, vibration exciting unit ACS1, ACS2, which are described above.

Each of the waveform data groups dL, dC, dR, dB is a set of pieces of sample waveform data. Each piece of sample waveform data, which is data for one sounding, has a volume envelope and is obtained by sampling a musical tone waveform of, e.g., a grand piano. For example, musical tone waveforms on which the waveform data groups dL, dC, dR, dB are based are obtained from musical tones of an acoustic grand piano recorded at positions corresponding to the four squawkers Sq.

Each of the waveform data groups dL, dC, dR, dB is provided for every tone pitch (key) and for each of plural stages (e.g., eight stages) of key depression velocity. Each waveform data group can be provided for every tone pitch range instead of for every tone pitch. In a case that the musical tone generator 15 is configured to be able to sound plural types of tone colors, each of the waveform data groups dL, dC, dR, dB can be provided for every tone color. Further, each waveform data group can be provided for each of stages (e.g., two or three stages) of pedal PD depression depth.

Figure 7:
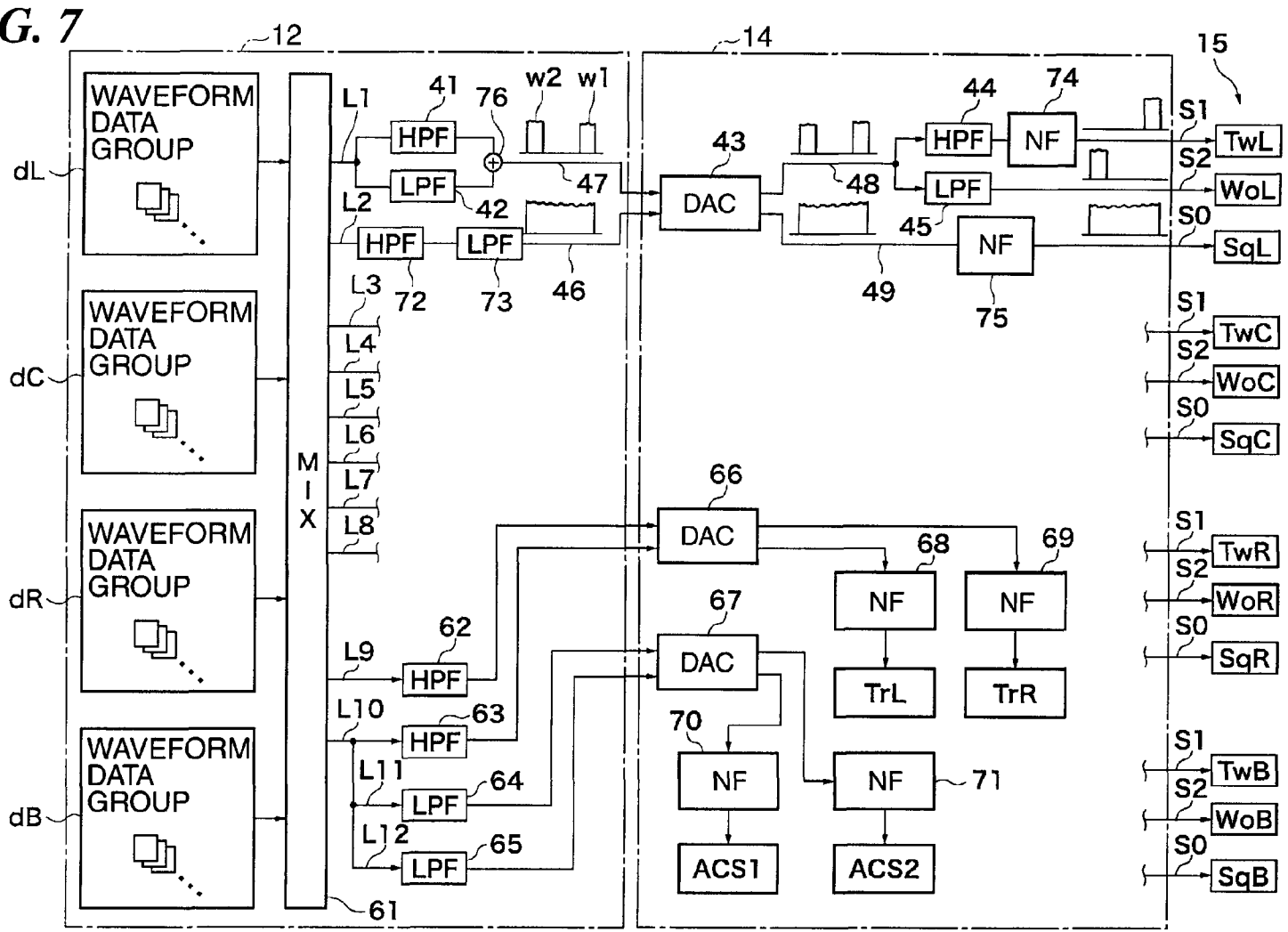
FIG. 7 is a block diagram showing the flow of signal processing in a DSP, a distributor, and a musical tone generator of the keyboard instrument.

FIG. 7 shows in block diagram the flow of signal processing in the DSP 12, the distributor 14, and the musical tone generator 15. The waveform data groups dL, dC, dR, dB are for use by the woofers Wo, the squawkers Sq, and the tweeters Tw for sound generation. The waveform data groups dL, dC are also for use by the transducer TrL and the vibration exciting units ACS1, ACS2, and the waveform data groups dC, dR are also for use by the transducer TrR.

A MIX 61 having a large number of input and output channels is supplied with waveform data from the waveform data groups dL, dC, dR, dB, and outputs signals from lines L1 to L12. Musical tone signals 51, S2 and S0 based on signals output from the lines L1, L2 are supplied to the speaker group spL (i.e., the set of tweeter TwL, woofer WoL, and squawker SqL). Similarly, musical tone signals S1, S2, and SO based on signals output from the lines L3, L4 are supplied to the speaker group spC, musical tone signals S1, S2, and S0 based on signals output from the lines L5, L6 are supplied to the speaker group spR, and musical tone signals S1, S2, and S0 based on signals output from the lines L7, L8 are supplied to the speaker group spB. Signals based on signals output from the lines L9 to L12 are supplied to the transducers TrL, TrR and the vibration exciting units ACS1, ACS2.

In FIG. 7, there is mainly illustrated the flow of one system for the speaker group spL, in which waveform data selected from the waveform data group dL (source) is processed. Illustrations of similar flows for other systems for the speaker groups spC, spR, spB, in which waveform data selected from the waveform data groups dC, dR, dB (sources) are processed, are partly omitted.

The DSP 12 includes HPFs (high-pass filters) 41, 62, 63 and 72, and includes LPFs (low-pass filters) 42, 64, 65 and 73. The distributor 14 includes 2-channel DACs (digital-to-analog converters) 43, 66 and 67, a HPF 44, a LPF 45, and NFs (noise filters) 68, 69, 70, 71, 74 and 75 each implemented by a low-pass filter. Under the control of the main CPU 11 (FIG. 6), the MIX 61 operates based on a control signal designating the selection of input and output and the degree of signal mixing. The above circuit elements are connected as shown in FIG. 7.

When any of the keys of the keyboard KB is depressed, wave data corresponding to the tone pitch of the depressed key and the stage to which a key depression velocity belongs is selected from each of the waveform data groups dL, dC, dR, dB. Processes on the selected data for sound emission are concurrently performed. In the following, sound emission from the speaker groups will be described by taking the system for the waveform data group dL as an example.

In the DSP 12, waveform data corresponding to the depressed key and the key depression velocity is selected from the waveform data group dL, and the selected waveform data is input into the MIX 61. In response to this, digital waveform signals including all the frequency band components based on the selected waveform data are output from the lines L1, L2 of the MIX 61.

Next, in the DSP 12, a high frequency band component w1 is obtained by the HPF 41 by removing low and intermediate frequency band components from the waveform signal output from the line L1, and a low frequency band component w2 is obtained by the LPF 42 by removing intermediate and high frequency band components from the waveform signal output from the line L1. Then, the frequency band components w1, w2 are added together by an adder 76, thereby creating a digital waveform signal 47 which does not contain the intermediate frequency band component. On the other hand, a digital waveform signal 46 which does not contain low and high frequency band components is obtained by the HPF 72 and the LPF 73 from the waveform signal output from the line L2. The HPF 72 and the LPF 73 connected in series with each other constitute a band pass filter.

Cutoff frequencies of the filters HPF 41, LPF 42, LPF 73, and HPF 72 are made larger in this order. In other words, relations of $fc_{HPF41}>fc_{LPF42}$ and $fc_{LPF73}>fc_{HPF72}$ are fulfilled, where $fc_{HPF41}$, $fc_{LPF42}$, $fc_{LPF73}$, and $fc_{HPF72}$ respectively represent the cutoff frequencies of these filters. By setting the cutoff frequencies of the filters so as to fulfill the above relations, the waveform signals 46, 47 having waveform components shown in FIG. 7 can be created. The cutoff frequency $fc_{LPF73}$ has a value of, e.g., 30 kHz, and the cutoff frequency $fc_{HPF72}$ has a value, e.g., from 1 kHz to 300 kHz. A relation of $fc_{HPF72} \geqq fcLPF42$ is fulfilled between the cutoff frequencies of the filters HPF 72 and LPF 42, and a relation of $fc_{HPF41} \geqq fc_{LPF73}$ is fulfilled between the cutoff frequencies of the filters HPF 41 and LPF 73. Cutoff frequencies of the NFs 68 to 71, 74, and 75 each have a value of, e.g., 30 kHz. The same cutoff frequency values are also used in the systems for processing waveform data selected from the waveform data groups dC, dR, dB (sources).

The waveform signals 46, 47 created by the DSP 12 are input, via different channels, into the 2-channel DAC 43 of the distributor 14. The DAC 43 converts the waveform signals 46, 47 into analog musical tone signals 49, 48 for respective channels. High frequency noise is removed from the musical tone signal 49 by the NF 75, whereby a musical tone signal S0 is produced and supplied to the squawker SqL. The squawker SqL sounds a musical tone from which noise is removed and which contains low, intermediate, and high frequency band components.

In one of signal paths, the musical tone signal 48 is processed by the HPF 44 and the NF 74, and supplied as a musical tone signal S1 to the tweeter TwL. Specifically, a low frequency band component and noise are removed by the HPF 44 and the NF 74 from the musical tone signal 48, and therefore, the musical tone signal S1 only contains a high frequency band component. In another signal path, the musical tone signal 48 is processed by the LPF 45 and supplied as a musical tone signal S2 to the woofer WoL. Since a high frequency band component is removed by the LPF 45 from the musical tone signal 48, the musical tone signal S2 only contains a low frequency band component. The cutoff frequency of the HPF 44 is equal to or slightly lower than that of the HPF 41, and the cutoff frequency of the LPF 45 is equal to or slightly higher than that of the LPF 42.

The musical tone signals S1, S2 are derived from the same source (waveform data group dL), but do not overlap each other in frequency band. The musical tone signals S0, S2 are the same in phase from each other, but opposite in phase from the musical tone signal S1.

The musical tone signals S1, S2, S0 are respectively supplied to the tweeter TwL, the woofer WoL, and the squawker SqL, while volume controllers provided in the lines for the musical tone signals 48, 49 are controlled by the master volume operating element of the operating element group 16. Volume allocation between the tweeter TwL, the woofer WoL, and the squawker SqL is controlled according to which key is depressed. For example, gains (volume allocation values) are such that the volume allocation to the tweeter TwL becomes greater for the keys for higher pitch tones and the volume allocation to the woofer WoL becomes smaller for the keys for higher pitch tones. Conversely, the volume allocation to the woofer WoL becomes greater for the keys for lower pitch tones and the volume allocation to the tweeter TwL becomes smaller for the keys for lower pitch tones. These volume control parameters are controlled by the main CPU 11.

The above described process is performed also in the systems for the speaker groups spC, spR, spB, in which waveform signals selected from the waveform data groups dC, dR, dB (sources) are processed.

As described previously, the waveform data groups dL, dC, dR are used also in the transducers TrL, TrR and the vibration exciting units ACS1, ACS2. The following is a description of the flow of signal processing for the systems from the waveform data groups dL, dC, dR to the transducers TrL, TrR and the vibration exciting units ACS1, ACS2.

Waveform data corresponding to the depressed key and the key depression velocity is selected from each of the waveform data groups dL, dC, dR, and selected waveform data are input into the MIX 61. Then, the waveform data selected from the waveform data groups dR, dC are mixed in the ratio of dR:dC=100:63, and the mixed signal is output from the MIX 61 to the line L9. The waveform data selected from the waveform data groups dL, dC are mixed in the ratio of dL:dC=100:63, and the mixed signal is output from the MIX 61 to each of the lines L10 to L12. It should be noted that these ratios are mere examples. The ratios maybe ones that fulfill relations of dR≧dC and dL≧dC. For example, the ratios may be 100:100 or 100:50.

The signals output to the lines L9, L10 are input into different channels of the 2-channel DAC 66 of the distributor 14 and converted into analog musical tone signals. High frequency noise (beyond audio frequency and about 30 kHz) are removed by the NFs 69, 68 from these analog musical tone signals, and the resultant tone signals are supplied to the transducers TrR, TrL.

On the other hand, the signals output to the lines L11, L12 are input into different channels of the 2-channel DAC 67 of the distributor 14 and converted into analog musical tone signals. High frequency noise (beyond audio frequency) is removed by the NFs 71, 79 from these analog musical tone signals, and the resultant tone signals are supplied to the vibration exciting units ACS2, ACS1.

In some cases, there is overlap in frequency band between musical tones sounded by the squawkers Sq and musical tones sounded by the woofers Wo. However, since each squawkers is disposed in the horizontal direction to close to the corresponding woofer whose signal source is the same as the squawker so as to partly overlap the woofer as viewed in plan, it is possible to decrease a difference between a distance between the squawker and the listening point, which is at nearly the same height level as that of the speaker box 50, and a distance between the woofer and the listening point. As a result, acoustic characteristic runaway due to sound wave interference can be reduced even in the region where there is a frequency band overlap between the squawker and the woofer. Since the audience are usually at the same height position as that of the speaker box 50 when the electronic keyboard instrument 100 is played on the stage, practical effects are noticeable.

According to this embodiment, signals each derived from waveform data selected from the corresponding waveform data group (source) and output from the lines L1, L3, L5, and L7 are each separated into the musical tone signals S1, S2 which do not overlap each another in frequency band, and the musical tone signals are sounded from the tweeters Tw and the woofers Wo. As a result, even if distances to listening points are different between the tweeters Tw and the woofers Wo, acoustic characteristic runaway (variations, dips, etc.) due to sound wave interference can be made small, and therefore the acoustic characteristic can be stabilized.

Since the squawkers Sq and the woofers Wo nearly overlap one another in plan view, the acoustic characteristic at the listening points (positions of audience) can be stabilized.

According to this embodiment, since the squawkers SqL, SqC, SqR are arranged in a line, the woofers WoL, WoC, WoR are also arranged in a line in the left-right direction, and the squawker SqB and the woofer WoB are located rearward of the other squawkers and woofers, the squawkers Sq and the woofers Wo are arranged to constitute a nearly plane sound source, and therefore, a spread feeling of sound similar to that of acoustic piano can be realized. With the arrangement having three speaker groups disposed on the front side and one speaker group disposed on the rear side, it is easy to allocate appropriate volumes to the resonance chambers Rs, Rw, thus contributing to efficiently arrange the speaker box 50 and the resonance chambers Rs, Rw at a position corresponding to a position of grand piano soundboard (i.e., the region where the intermediate plate 38 is disposed).

In addition, since the tweeters TwL, TwR are located forward of the squawkers SqL, SqR and the tweeter TwC is located rearward of the squawker SqC, a difference between distances to the player can be made small between the tweeters TwL, TwC, TwR, thus making it possible to realize a spread feeling of sound, similar to that of acoustic piano, in high pitch tones at the position of the player.

Since the speaker box 50 is disposed, as viewed in plan, in a region corresponding to a region where a grand piano soundboard is disposed, a position of sound emission from the speaker box 50 can be made close to the position of the grand piano soundboard, thereby realizing acoustics similar to the acoustics of grand piano.

Since signals derived from waveform data selected from at least waveform data groups dL, dR (sources) and output from the lines L10, L9 are supplied to the transducers TrL, TrR, and sounds by vibrations of the soundboard 35 are produced concurrently with sound emission from the squawkers SqL, SqR, a spread feeling of sound further similar to that of acoustic piano can be realized.

According to this embodiment, since the squawkers Sq and the tweeters Tw are directed upwardly and the woofers Wo are conversely directed downwardly, sounds are emitted in both upward and downward directions from the speakers solely for upward sound emission and from the speakers solely for downward sound emission, thus making it possible to realize acoustics similar to the acoustics of acoustic piano in that sounds reflected by the roof plate 25 and the floor are transmitted to the audience.

Since rear parts of the resonance chambers Rs, Rw in the speaker box 50 are constituted by the one horizontal partition plate 51, the speaker box 50 can be integrally formed, while prevented from becoming complicated in construction.

Since the stepped portion 50*a* is provided on the upper side of the speaker box 50, and the resonance chambers Rw for the woofers Wo for low pitch tones are formed on the lower side of the speaker box 50 where the stepped portion 50*a* is not provided, it is possible to ensure a large volume of the resonance chambers Rw and improve the space-saving in the instrument main body 30. Insofar as this point is concerned, the stepped portion 50*a* can be provided on the lower side of the speaker box 50, and the squawkers Sq, tweeters Tw, woofers Wo, and resonance chambers can be disposed such that the vertical positional relation between the intermediate/high pitch tone side and the low pitch tone side is reversed from that in the embodiment.

Insofar as the suppression of sound wave interference between the tweeters Tw and the woofers Wo is concerned, it is unnecessary to direct the tweeters Tw and the woofers Wo in vertically opposite directions, but is enough to direct the tweeters and the woofers in opposite directions.

It should be noted that to simplify the construction, the HPF 41 and the LPF 42 can be eliminated in the signal processing in FIG. 7, and only the digital waveform signal 46 input to the DAC 43 can be used to obtain the musical tone signals S0, S1, S2. In that case, the musical tone signal S0 can be obtained as previously described. Although the musical tone signal 48 cannot be obtained, it is possible to branch the musical tone signal 49 output from the DAC 43 short of the NF 75 and input the branched signal into the HPF 44 and the LPF 45 as with the musical tone signal 48 in FIG. 7, thereby separating the branched signal into the musical tone signals S1, S2.

It should be noted that the waveform data groups dL, dC, dR, dB as signal sources may not be stored in the electronic keyboard instrument 100, but can be read from an external device. The form of the signal sources is not limited to the form of the waveform data groups dL, dC, dR, dB.

It should be noted that musical tones can be generated not only by the depression of keys of the keyboard KB, but also based on automatic performance data, e .g., MIDI data, stored beforehand or externally input. In that case, waveform data is selected from the waveform data groups dL, dC, dR, dB in accordance with information on, e.g., tone pitch and key depression velocity in the automatic performance data read sequentially, and is processed as previously described.

What is claimed is:

1. An electronic keyboard instrument comprising:

an instrument main body;

a speaker box disposed on said instrument main body;

a plurality of speakers disposed at an upper part of said speaker box so as to be directed upward when the electronic keyboard instrument is in use for performance;

a plurality of speakers disposed at a lower part of said speaker box so as to be directed downward when the electronic keyboard instrument is in use for performance;

one partition plate provided in said speaker box so as to partition an internal space of said speaker box into upper and lower internal spaces;

resonance chambers formed independently of one another in the upper internal space of said speaker box so as to correspond to respective ones of said speakers disposed to be directed upward; and resonance chambers formed independently of one another in the lower internal space of said speaker box so as to correspond to respective ones of said speakers disposed to be directed downward, wherein rear parts of said resonance chambers are constituted by said one partition plate.

2. The electronic keyboard instrument according to claim 1, wherein said instrument main body is formed into a grand piano shape, and said speaker box is disposed in a region corresponding to a region where a grand piano soundboard is disposed.

3. The electronic keyboard instrument according to claim 1, wherein said speakers are comprised of four speakers disposed above said partition plate and four speakers disposed below said partition plate, three of the four speakers disposed above said partition plate are arranged in a line along a left-right direction on a front side of said speaker box and a remaining one of these four speakers is located on a rear side of said speaker box, and three of the four speakers disposed below said partition plate are arranged in a line along the left-right direction on the front side of said speaker box and a remaining one of these four speakers is located on the rear side of said speaker box.

4. The electronic keyboard instrument according to claim 3, wherein the resonance chamber corresponding to the remaining one of the four speakers disposed above said partition plate is in contact, via a vertical partition plate, with the resonance chambers corresponding to the three of these four speakers, and the resonance chamber corresponding to the remaining one of the four speakers disposed below said partition plate is in contact, via a vertical partition plate, with the resonance chambers corresponding to the three of these four speakers.

5. The electronic keyboard instrument according to claim 2, wherein said speakers are comprised of four speakers disposed above said partition plate and four speakers disposed below said partition plate, three of the four speakers disposed above said partition plate are arranged in a line along a left-right direction on a front side of said speaker box and a remaining one of these four speakers is located on a rear side of said speaker box, and three of the four speakers disposed below said partition plate are arranged in a line along the left-right direction on the front side of said speaker box and a remaining one of these four speakers is located on the rear side of said speaker box.

6. The electronic keyboard instrument according to claim 5, wherein the resonance chamber corresponding to the remaining one of the four speakers disposed above said partition plate is in contact, via a vertical partition plate, with the resonance chambers corresponding to the three of these four speakers, and the resonance chamber corresponding to the remaining one of the four speakers disposed below said partition plate is in contact, via a vertical partition plate, with the resonance chambers corresponding to the three of these four speakers.

7. The electronic keyboard instrument according to claim 1, wherein a stepped portion is provided on one of upper and lower sides of said speaker box with respect to said one partition plate, and speakers for low pitch tones among said speakers are disposed on another of the upper and lower sides of said speaker box and speakers for intermediate or high pitch tones among said speakers are disposed on the one of the upper and lower sides of said speaker box.

8. The electronic keyboard instrument according to claim 7, wherein electrical components are disposed in a space of the stepped portion.

* * * * *